US012600391B2

(12) United States Patent
Yasumoto

(10) Patent No.: US 12,600,391 B2
(45) Date of Patent: Apr. 14, 2026

(54) CONVEYANCE SYSTEM

(71) Applicant: MURATA MACHINERY, LTD., Kyoto (JP)

(72) Inventor: Hiroyuki Yasumoto, Ise (JP)

(73) Assignee: MURATA MACHINERY, LTD., Kyoto (JP)

( * ) Notice: Subject to any disclaimer, the term of this patent is extended or adjusted under 35 U.S.C. 154(b) by 70 days.

(21) Appl. No.: 18/704,983

(22) PCT Filed: Jul. 20, 2022

(86) PCT No.: PCT/JP2022/028238
§ 371 (c)(1),
(2) Date: Apr. 26, 2024

(87) PCT Pub. No.: WO2023/079797
PCT Pub. Date: May 11, 2023

(65) Prior Publication Data

US 2025/0269886 A1 Aug. 28, 2025

(30) Foreign Application Priority Data

Nov. 2, 2021 (JP) ..... 2021-179184

(51) Int. Cl.
*B61L 27/04* (2006.01)
*B61B 3/02* (2006.01)
*B61L 23/04* (2006.01)

(52) U.S. Cl.
CPC ..... *B61L 27/04* (2013.01); *B61B 3/02* (2013.01); *B61L 23/041* (2013.01)

(58) Field of Classification Search
CPC ..... B61L 27/04; B61L 23/041; B61B 3/02
See application file for complete search history.

(56) References Cited

U.S. PATENT DOCUMENTS 6,285,951 B1 * 9/2001 Gaskins ..... G05D 1/0217 73/178 R
2006/0253244 A1 * 11/2006 Matsuda ..... G08G 1/0104 701/117

(Continued)

FOREIGN PATENT DOCUMENTS

CN 111123929 A 5/2020
JP H04340607 A 11/1992

(Continued)

OTHER PUBLICATIONS

English Translation of Official Communication issued in International Patent Application No. PCT/JP2022/028238, mailed on Oct. 4, 2022, 4 pages.

(Continued)

*Primary Examiner* — Sizo B Vilakazi
(74) *Attorney, Agent, or Firm* — Keating & Bennett, LLP

(57) ABSTRACT

A conveyance system includes carriers capable of traveling along a rail; and a controller configured or programmed to control the carriers. The conveyance system searches for a traveling route allowing at least one of the carriers to travel along the rail to a target point to cause the at least one of the carriers to travel along the traveling route, and re-searches for the traveling route in a case in which the at least one of the carriers passes through an update point set on the rail.

13 Claims, 8 Drawing Sheets

(56) References Cited

U.S. PATENT DOCUMENTS

| | | | | |
|---|---|---|---|---|
| 2009/0299555 | A1* | 12/2009 | Houpt | B61L 27/16 701/19 |
| 2016/0004252 | A1* | 1/2016 | Nagasawa | G05D 1/02 701/26 |
| 2019/0241202 | A1* | 8/2019 | Thomas | B61L 27/16 |
| 2021/0188558 | A1* | 6/2021 | Andreae | B65G 19/025 |
| 2022/0144325 | A1* | 5/2022 | Kurz | B61L 15/0081 |

FOREIGN PATENT DOCUMENTS

| | | | |
|---|---|---|---|
| JP | 2009-277180 | A | 11/2009 |
| JP | 2016170580 | A | 9/2016 |
| JP | 2020030723 | A | 2/2020 |

OTHER PUBLICATIONS

Official Communication issued in International Patent Application No. PCT/JP2022/028238, mailed on May 16, 2024, 2 pages.
Official Communication issued in International Patent Application No. PCT/JP2022/028238, mailed on Oct. 4, 2022.

* cited by examiner

CONVEYANCE SYSTEM

BACKGROUND OF THE INVENTION

1. Field of the Invention

The present invention relates to conveyance systems.

2. Description of the Related Art

There is known a conveyance system including a plurality of carriers capable of traveling along a rail, and a controller to control the carriers. As this kind of technique, for example, Japanese Unexamined Patent Publication No. 2006-313408 discloses a technique in which the controller successively and periodically transmits congestion information to the carriers, and each of the carriers re-searches for a traveling route based on the received congestion information.

SUMMARY OF THE INVENTION

In the conveyance system as described above, a timing when the traveling route is re-searched for depends on a timing when the carrier receives the congestion information. Due to this, for example, even if the carrier re-searches for and updates the traveling route, there is the possibility that a required time for the carrier to reach a destination cannot be appropriately reduced depending on the timing, and conveyance efficiency cannot be improved.

Example embodiments of the present invention provide conveyance systems that improve conveyance efficiency.

A conveyance system according to an aspect of an example embodiment of the present invention includes a plurality of carriers capable of traveling along a rail, and a controller configured or programmed to control the carriers and cause the conveyance system to search for a traveling route allowing at least one of the plurality of carriers to travel along the rail to a target point to cause the at least one of the plurality of carriers to travel along the traveling route, and re-search for the traveling route in a case in which the at least one of the plurality of carriers passes through an update point set on the rail.

In this conveyance system, the traveling route is re-searched for when at least one of the plurality of carriers passes through the update point, so that the traveling route can be updated at an appropriate timing by determining the update point to be an appropriate position, for example. Due to this, for example, it is possible to prevent a timing of re-search from becoming too late or prevent re-searching from being infrequent, and the required time for the carrier to reach a target point can be appropriately reduced. In other words, the traveling route of the carrier can be updated at an appropriate timing, and conveyance efficiency can be improved.

In a conveyance system according to an aspect of an example embodiment of the present invention, the controller may be configured or programmed to perform search processing of searching for the traveling route, transmission processing of transmitting, to the carrier, a traveling command to cause the carrier to travel along the searched traveling route in a case in which the search processing is performed, and re-search processing of performing the search processing again in a case in which the at least one of the plurality of carriers passes through the update point. Due to this, the controller can search and re-search for the traveling route of the at least one of the plurality of carriers.

In a conveyance system according to an aspect of an example embodiment of the present invention, the rail may extend through a plurality of areas, and the update point may be at a boundary between adjacent ones of the plurality of areas. In this case, the traveling route of the at least one of the plurality of carriers can be updated to be an appropriate route at a timing when the at least one of the plurality of carriers passes through the update point at the boundary between the plurality of areas.

In a conveyance system according to an aspect of an example embodiment of the present invention, the controller may be provided for each of the plurality of areas, and each of the controllers may be configured or programmed to control the at least one of the plurality of carriers in each of the plurality of areas. Due to this, the traveling route of the at least one of the plurality of carriers can be updated to be an appropriate route at a timing when the at least one of the plurality of carriers passes through the update point at a boundary between the plurality of areas in which each controller is configured or programmed to control the carrier.

A conveyance system according to an aspect of an example embodiment of the present invention may include a power supply located along the rail to supply power to the at least one of the plurality of carriers, and the power supply may be provided for each of the plurality of areas. Due to this, the traveling route of the at least one of the plurality of carriers can be updated to be an appropriate route at a timing when the at least one of the plurality of carriers passes through the update point at a boundary between the plurality of areas in which each power supply supplies power.

A conveyance system according to an aspect of an example embodiment of the present invention may determine a traveling area including the plurality of areas through which the at least one of the plurality of carriers passes before arriving at the target point so that a total value of costs of the respective areas of the traveling area is decreased or minimized, and may determine the traveling route based on the determined traveling area. In this case, in search of the traveling route, the traveling route can be determined so that a cost to reach the target point of the at least one of the plurality of carriers is reduced (for example, a required time is shortened) based on the plurality of areas through which the at least one of the plurality of carriers passes before arriving at the target point.

In a conveyance system according to an aspect of an example embodiment of the present invention, in a case in which a predetermined number or more of the plurality of carriers are present in the area, the cost of the area may be increased. In this case, the traveling route can be determined to avoid the area in which the predetermined number or more of the plurality of carriers are present.

In a conveyance system according to an aspect of an example embodiment of the present invention, the rail may include a plurality of segments, and the traveling route including the plurality of segments through which the at least one of the plurality of carriers passes before arriving at the target point may be determined so that a total value of costs of the respective segments of the traveling route is decreased or minimized. In this case, in search of the traveling route, it is possible to determine the traveling route including the plurality of segments through which the at least one of the plurality of carriers passes before arriving at the target point so that the cost to reach the target point of the carrier is reduced (for example, the required time is shortened).

In a conveyance system according to an aspect of an example embodiment of the present invention, in a case in which a time required for the at least one of the plurality of carriers to pass through the respective segment is equal to or longer than a predetermined time, the cost of the respective segment may be increased. In this case, the traveling route can be determined to avoid the segment in which the time required for the at least one of the plurality of carriers to pass through the segment is equal to or longer than the predetermined time.

In a conveyance system according to an aspect of an example embodiment of the present invention, in a case in which a speed of the at least one of the plurality of carriers at the time of passing through the respective segment is equal to or lower than a predetermined speed, the cost of the respective segment may be increased. In this case, the traveling route can be determined to avoid the segment in which the speed of the at least one of the plurality of carriers at the time of passing through the segment is equal to or lower than the predetermined speed.

In a conveyance system according to an aspect of an example embodiment of the present invention, in a case in which a predetermined number or more of the plurality of carriers are present in the respective segment, the cost of the respective segment may be increased. In this case, the traveling route can be determined to avoid the segment in which the predetermined number or more of the plurality of carriers are present.

In a conveyance system according to an aspect of an example embodiment of the present invention, in a case in which a value obtained by dividing a length of a respective segment by a number of the plurality of carriers present in the respective segment is smaller than a predetermined value, the cost of the segment may be increased. In this case, the traveling route can be determined to avoid the segment that is relatively congested.

In a conveyance system according to an aspect of an example embodiment of the present invention, re-search of the traveling route may be permitted and stopped in response to an input operation by a user. In this case, for example, the user can selectively switch between a mode of performing re-search of the traveling route and a mode of not performing re-search of the traveling route as needed.

According to aspects of example embodiments of the present invention, it is possible to provide conveyance systems with which conveyance efficiency can be improved.

The above and other elements, features, steps, characteristics and advantages of the present invention will become more apparent from the following detailed description of the example embodiments with reference to the attached drawings.

DETAILED DESCRIPTION OF THE EXAMPLE EMBODIMENTS

Figure 1:
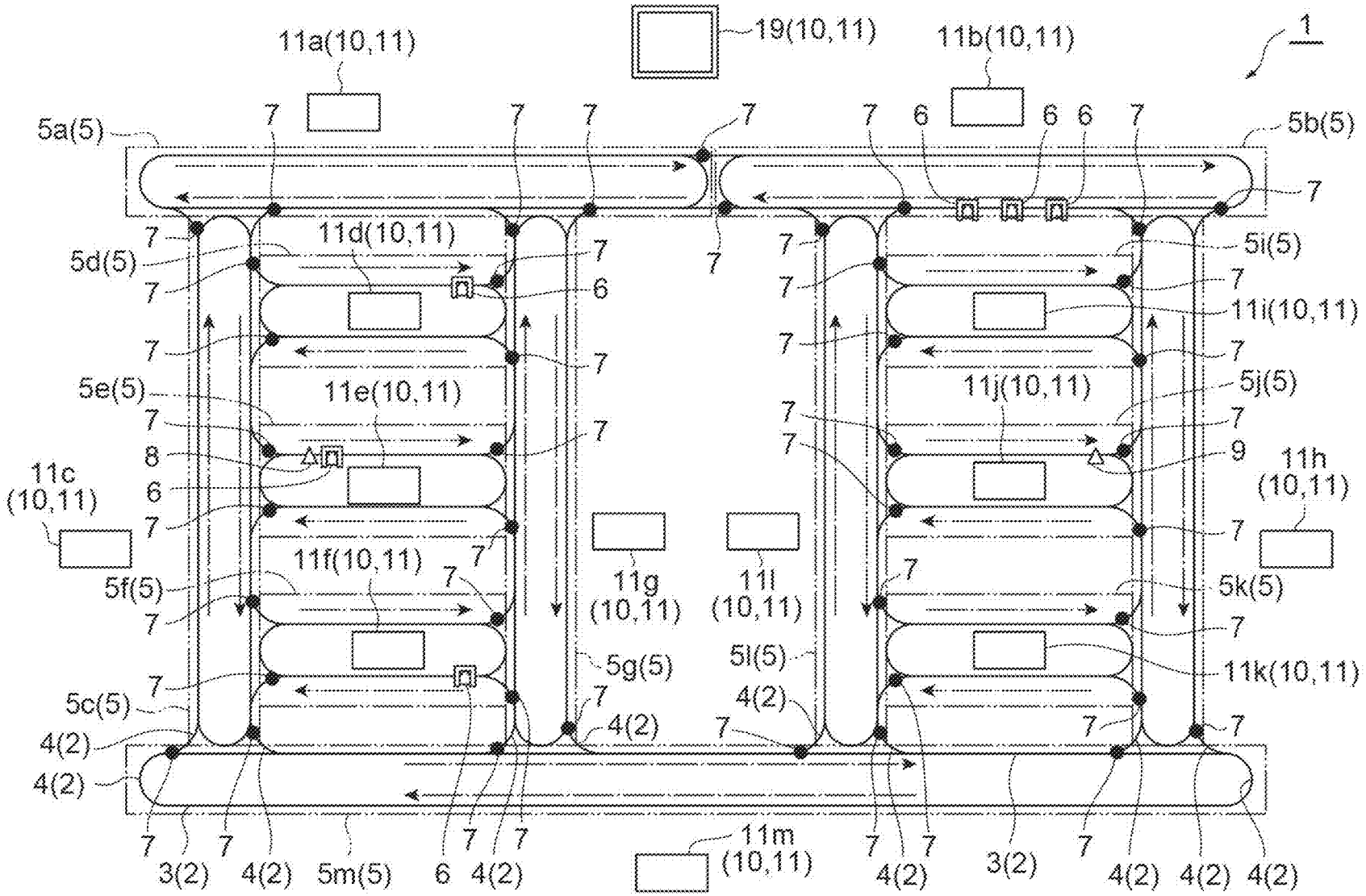
FIG. 1 is a schematic configuration diagram of a conveyance system according to an example embodiment of the present invention.

The following describes example embodiments with reference to the drawings. In description of the drawings, the same element is denoted by the same reference numeral, and redundant description will not be repeated. Dimension ratios in the drawings do not necessarily agree with those in the description.

Figure 2:
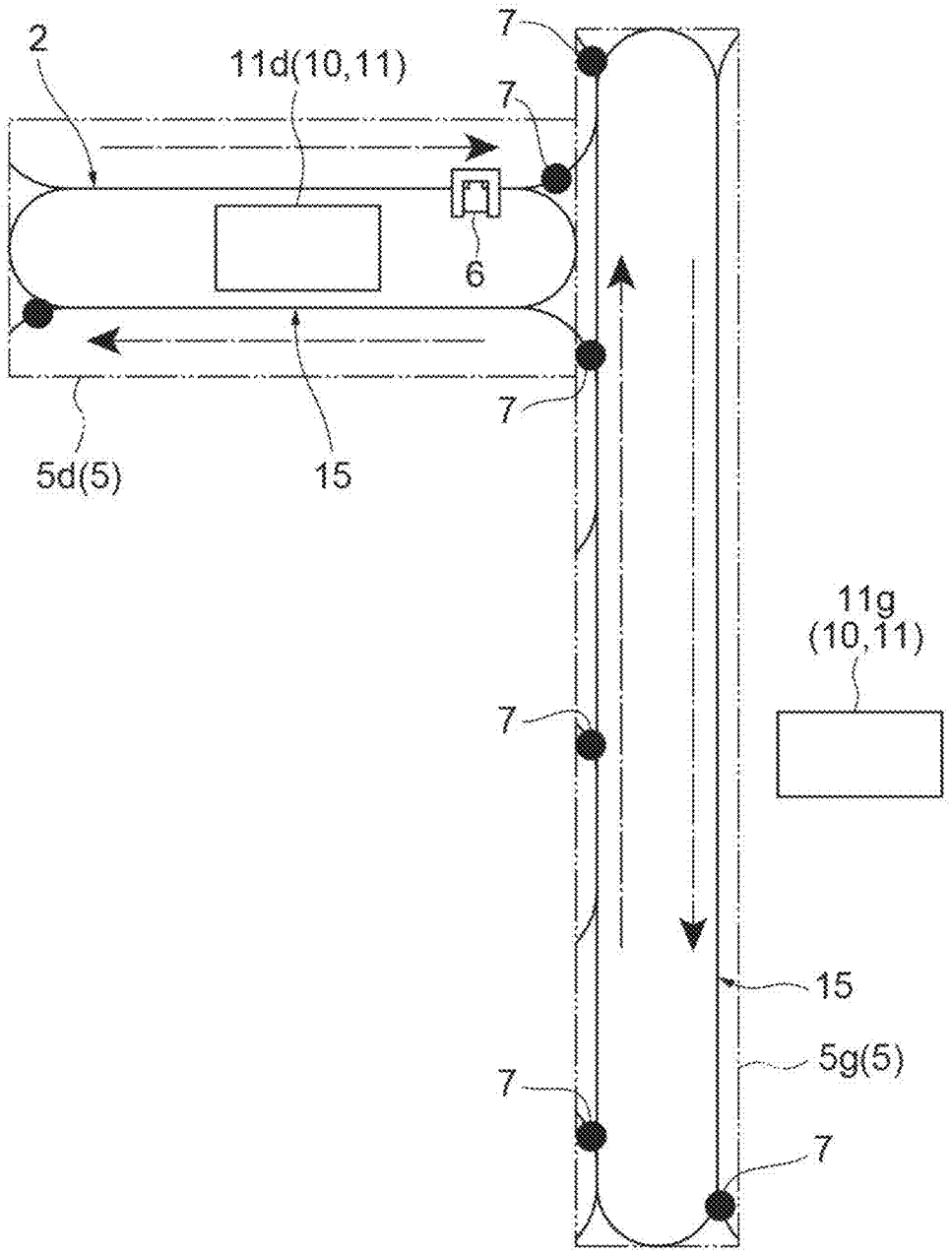
FIG. 2 is a schematic configuration diagram in which a portion of the conveyance system in FIG. 1 is enlarged.
Figure 3:
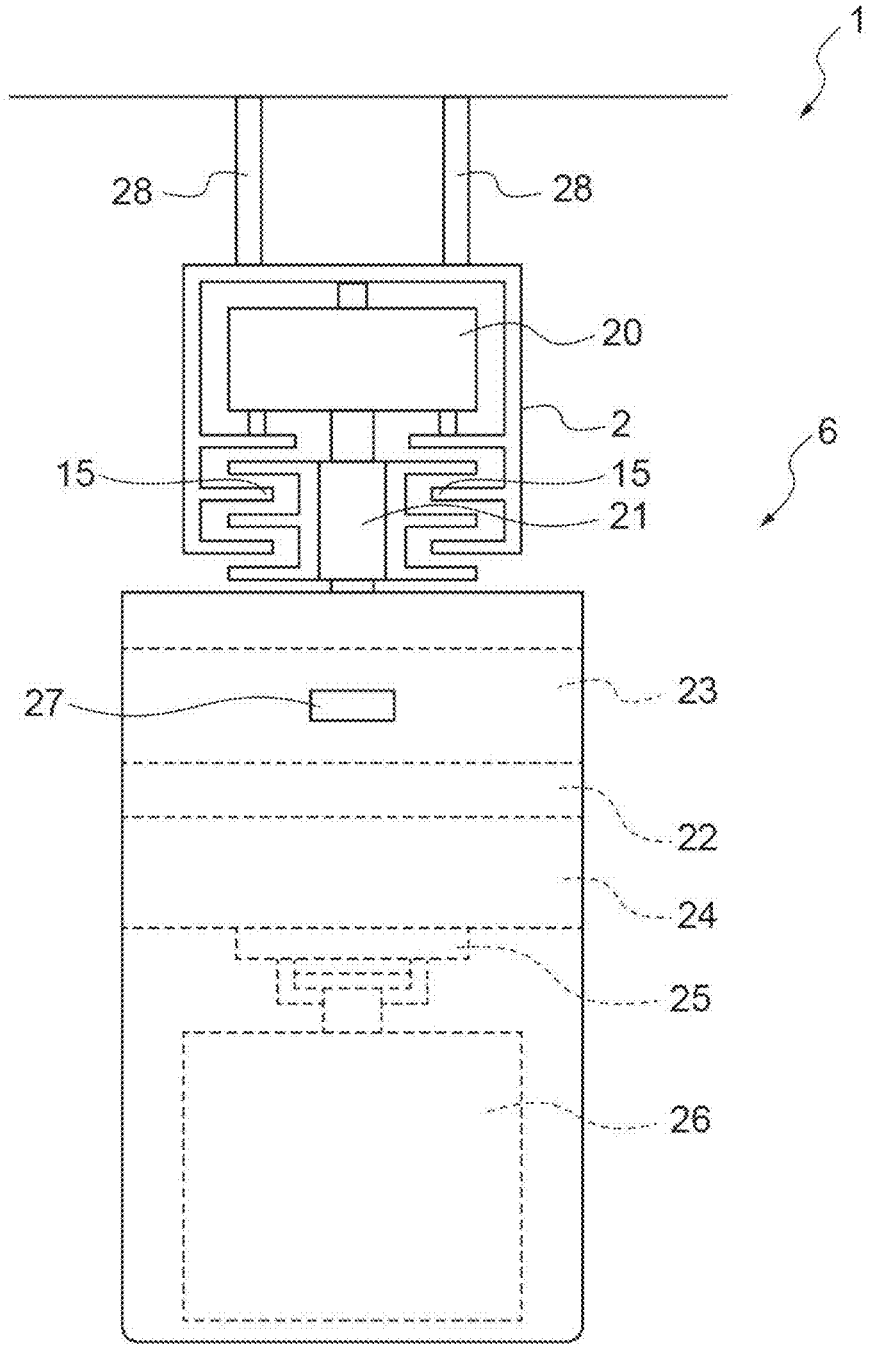
FIG. 3 is a front schematic diagram of a carrier in FIG. 1 viewed from a traveling direction.

As illustrated in FIG. 1 to FIG. 3, a conveyance system 1 is a system that conveys an article 26. The article 26 is, for example, a container that is capable of storing a plurality of semiconductor wafers, and may be a glass substrate, a general component, or the like. The conveyance system 1 includes a rail 2, a plurality of carriers 6, a controller 10, and a power supply 15.

The rail 2 is a predetermined route for the carrier 6 to travel. The rail 2 is laid near a ceiling as an overhead space of an operator, for example. The rail 2 is supported and hung by a pillar 28 (refer to FIG. 3). The rail 2 includes a plurality of segments. The rail 2 includes a segment 3 extending in a linear shape, and a segment 4 extending in a curved shape. In the rail 2 illustrated in FIG. 1, reference numerals of segments 3 and 4 are added to only some of the segments for simplification, but the other portions are also the segments included in the rail 2. In each of the segments 3 and 4, a cost related to an estimated time required for the carrier 6 to pass therethrough, for example, is set in advance.

The rail 2 includes the segments 3 and 4, a merging point at which the segments 3 and 4 merge with each other, and a diverging point at which one segment 3 or one segment 4 diverges into a plurality of the segments 3 and 4. The route of the rail 2 is a one-way route along which the carrier 6 travels only in one direction as indicated by an arrow of an alternate long and short dash line in FIG. 1. A layout of the rail 2 is not particularly limited, and various layouts can be used. A plurality of point marks are attached to the rail 2 to be arranged at regular intervals along an extending direction of the rail 2. Examples of the point mark include a barcode and the like.

The rail 2 preferably extends through a plurality of areas 5*a* to 5*m*. A plurality of areas 5 are partitioned to be adjacent to each other, for example. The area 5 includes the segments 3 and 4. The segment 3 or the segment 4 may be divided by the areas 5 at a middle point thereof. The area 5 includes a rail around which the carrier 6 can circle by the linear-shaped segments 3 and 3 and the curved-shaped segments 4 and 4. The area 5 includes the segments 4 extending from the rail around which the carrier 6 can circle to the adjacent areas 5. The carrier 6 can move between the areas 5 via the segments 4. A range and the number of the areas 5 are not particularly limited. A size of the area 5 may be set depending on specifications and the like.

The carrier 6 is a vehicle that can travel along the rail 2, in other words, the carrier 6 can travel along a predetermined route. The carrier 6 conveys an article. The carrier 6 is an unmanned carrier of an overhead traveling type. The carrier 6 is also called conveyance vehicle (conveyance carrier), overhead traveling vehicle (overhead traveling carrier), or traveling vehicle (traveling carrier), for example. The number of the carriers 6 included in the conveyance system 1 is not particularly limited, but preferably is multiple, for example. The carrier 6 is, for example, a vehicle driven by a linear motor, and includes an electromagnetic linear motor as a driving source, for example. Due to this, the carrier 6 can achieve smooth and efficient acceleration and deceleration, and high-speed continuous operation with a short distance between vehicles.

As illustrated in FIG. 3, the carrier 6 includes a traveling unit 20 and a power receiving communication unit 21. The traveling unit 20 causes the carrier 6 to travel along the rail 2. The power receiving communication unit 21 receives power from the power supply 15 on the rail 2 side by non-contact power supply, for example. The carrier 6 includes a θ drive 22, a transverse feed unit 23 to transversely feed a lower portion with respect to the rail 2, a lifting driving unit 24, and a lifting platform 25. The θ drive 22 turns the lifting driving unit 24 within a horizontal plane, and controls a posture of the article 26. The lifting driving unit 24 raises and lowers the lifting platform 25 grasping the article 26. A chuck is provided on the lifting platform 25 to freely grasp or release the article 26. The θ drive 22 and the transverse feed unit 23 are not necessarily provided.

The carrier 6 includes a linear sensor 27. The linear sensor 27 is a vehicle-to-vehicle sensor that detects an interval between itself and the carrier 6 in front. The linear sensor 27 is a sensor that can detect the carrier 6 that is present directly in front of it. The linear sensor 27 emits laser light toward a front side of the host carrier 6 (the carrier 6 including this linear sensor 27), and detects reflected light reflected by a reflector of the front carrier 6 to detect the front carrier 6. The linear sensor 27 is provided on a fall prevention cover on a front side of the carrier 6, for example. The linear sensor 27 transmits a detection result thereof to the controller 10 (described later). The carrier 6 may include a curve sensor as a sensor that can detect the carrier 6 that is present in front and traveling on a curve route.

The carrier 6 includes a position acquisition unit (not illustrated) configured to acquire position information related to a position on the rail 2 of the carrier 6. The position acquisition unit includes a reading unit configured to read a point mark on the rail 2, and the like. The position information of the carrier 6 includes, for example, information about a point mark obtained by the reading unit, and information about a traveling distance after passing through the point mark.

As illustrated in FIG. 2 and FIG. 3, the power supply 15 includes a power feeder provided for each of the areas 5 along the rail 2. A plurality of the power supplies 15 are provided for the respective areas 5*a* to 5*m*. That is, each of the power supplies 15 can supply power to the carrier 6 present in each of the areas 5*a* to 5*m* from a power source (not illustrated), along the rail 2. Each of the areas 5*a* to 5*m* corresponds to a zone to control power supply from corresponding one of the power supplies 15.

The controller 10 is an electronic control unit (ECU) including a central processing unit (CPU), a read only memory (ROM), a random access memory (RAM), and the like. The controller 10 can be configured as software such that a computer program stored in a ROM is loaded into a RAM to be executed by a CPU, for example. The controller 10 may be configured as hardware including an electronic circuit and the like. As illustrated in FIG. 1 and FIG. 2, the controller 10 includes a plurality of area controllers 11*a* to 11*m*, and a host controller 19. Each of the area controllers 11 and the host controller 19 may be defined of one device, for example, or may be defined by a plurality of devices. In a case in which it includes a plurality of devices, the devices are connected via a communication network such as the Internet or an intranet to logically construct one area controller and the host controller 19. The area controllers 11*a* to 11*m* are connected to the host controller 19 via a communication network such as the Internet or an intranet.

The area controllers 11*a* to 11*m* are provided for the respective areas 5*a* to 5*m*. That is, each of the area controllers 11*a* to 11*m* controls the carrier 6 in each of the areas 5*a* to 5*m*. In other words, one of the area controllers 11 puts one of the areas 5 under control, thereby controlling the carrier 6 in the area 5. Each of the area controllers 11*a* to 11*m* can communicate with the carrier 6 present in each of the areas 5*a* to 5*m*. Each of the areas 5*a* to 5*m* corresponds to a zone under control of corresponding one of the area controllers 11*a* to 11*m*. In the example in the drawing, each of the area controllers 11 is assigned to the area 5 to which a sign of the same alphabet as an alphabet added to a sign of the area controller 11 is added. Each of the areas 5 controlled under the respective area controllers 11 may be referred to as "controlled area 5" hereinafter. The area controller 11 includes layout data as data related to a layout of the rail 2. The layout data includes information about the areas 5, the segments 3 and 4, traveling directions of the segments 3 and 4, an update point 7 (described later), and the like. Alternatively, the host controller 19 may include the layout data.

Figure 4:
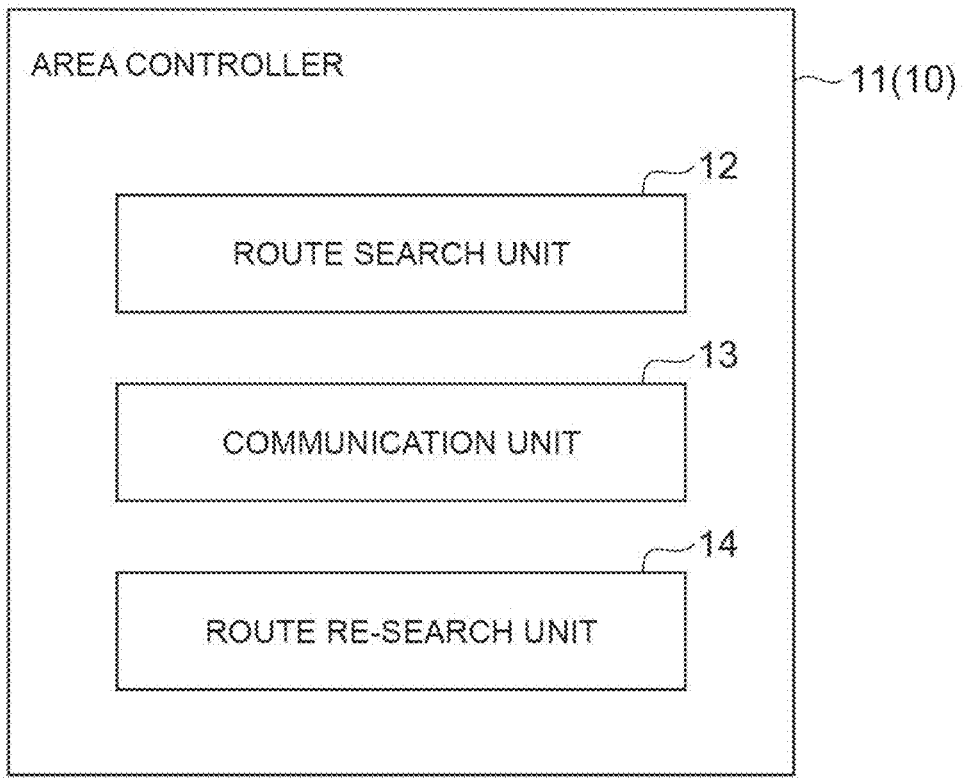
FIG. 4 is a block diagram illustrating a functional configuration of a controller in FIG. 1.

As illustrated in FIG. 4, each of the area controllers 11 is configured or programmed to include a route search unit 12, a communication unit 13, and a route re-search unit 14. Each of the area controllers 11 is configured or programmed to select any one of the carriers 6 that is present in the controlled area 5 and can convey the article 26, and to transmit (assign) a conveyance command to the selected carrier 6 (hereinafter also referred to as "subject carrier 6" in some cases). The conveyance command includes a traveling command to cause the carrier 6 to travel to a target point 9 (refer to FIG. 1) such as a load port at a conveyance destination along a traveling route, and a grab command to grab the article 26 at the target point 9 or an unloading command to unload the held article 26 to the load port. For example, the conveyance command can be created by each of the area controllers 11 in response to a request from the host controller 19. The subject carrier 6 is not particularly limited, and may be any vacant carrier 6. The vacant carrier 6 includes the carrier 6 to which the conveyance command is not assigned yet, the carrier 6 in a vacant state that has not conveyed the article 26.

The route search unit 12 performs search processing to search for a traveling route of the traveling command. The traveling route is a route on which the subject carrier 6 is scheduled to travel. The route search unit 12 searches for, for example, the traveling route on which the subject carrier 6 is scheduled to travel from a starting point 8 (refer to FIG. 1) as a present point to the target point 9 (refer to FIG. 1). The starting point 8 and the target point 9 are not particularly limited, and may be optional points on the rail 2. Details about the search processing for the traveling route performed by the route search unit 12 will be described later.

The communication unit 13 periodically communicates with the carriers 6 in the controlled area 5. For example, the communication unit 13 of each of the area controllers 11 transmits a state inquiry to the carrier 6 in the controlled area 5. The carrier 6 that has received the state inquiry transmits a state report including position information, speed information, and the like of itself to each of the communication units 13. By successively and periodically performing such communication with the carriers 6, each of the communication units 13 grasps a state of each of the carriers 6 in each controlled area 5 (including the present position, whether the carriers 6 is stopping or traveling, and the like).

The communication unit 13 communicates with the host controller 19. Each of the communication units 13 transmits the grasped state of each of the carriers 6 to the host controller 19, for example. Each of the communication units 13 transmits, to the host controller 19, basic information such as the number of the carriers 6 in each of the controlled areas 5 (hereinafter also referred to as "the number of the carriers in the area" in some cases), a time required for passing through the segments in each of the controlled areas 5 (hereinafter also referred to as "required time" in some cases), a speed for passing through the segments in each of the controlled areas 5 (hereinafter also referred to as "passing speed" in some cases), the number of the carriers 6 for each segment in each of the controlled areas 5 (hereinafter also referred to as "the number of the carriers in the segment" in some cases), and a value obtained by dividing a length of the segment in each of the controlled areas 5 by the number of the carriers present in the segment (hereinafter also referred to as "divided value" in some cases). Each of the communication units 13 receives various pieces of information from the host controller 19. For example, each of the communication units 13 receives the basic information of each of the areas 5 other than the controlled area 5 from the host controller 19.

In each of the area controllers 11, in a case in which the route search unit 12 performs the search processing, the communication unit 13 transmits the conveyance command including the traveling command to cause the carrier 6 to travel along the searched traveling route to the subject carrier 6. The subject carrier 6 that has received the conveyance command from the communication unit 13 travels on the rail 2 along the traveling route of the traveling command included in the conveyance command.

In a case in which the carrier 6 passes through the update point 7, the route re-search unit 14 performs re-search processing of performing the search processing again by the route search unit 12. The update point 7 is a point set on the rail 2. The update point 7 is a point set in advance in accordance with specifications of the conveyance system 1, and is a point that can be appropriately updated in accordance with changes and the like in the specifications of the conveyance system 1. Examples of the specifications of the conveyance system 1 include a layout of the rail 2. The update point 7 is a point that is set so that the re-search processing is performed when the carrier 6 passes therethrough, and is a point on the rail 2 to be a trigger for the re-search processing. Herein, the update point 7 is a point provided at a boundary between the areas 5 adjacent to each other. In the drawing, for convenience of explanation, the update point 7 is indicated by a circle on the rail 2. For example, when the communication unit 13 receives, from the carrier 6, a state report indicating that the carrier 6 has passed through the update point 7, the route re-search unit 14 performs the re-search processing to cause the route search unit 12 to perform the search processing again.

Next, the following describes details about the search processing for the traveling route performed by the route search unit 12. Hereinafter, the search processing for the traveling route may be simply referred to as route search processing in some cases. In the route search processing, at least one of area search processing and segment search processing is performed.

The area search processing is processing of determining the segment in which the carrier 6 travels in each traveling area after determining the traveling area as an area through which the subject carrier 6 passes before arriving at the target point 9 based on the basic information obtained by each of the area controllers 11. In the area search processing, the traveling area including any of the areas 5*a* to 5*m* through which the carrier 6 passes before arriving at the target point 9 is determined so that a total value of costs of the areas of the traveling area is decreased or minimized.

The cost of each of the areas 5 included in the traveling area is calculated based on the basic information. The cost of each of the areas 5 is, for example, calculated based on a required time for each segment in the area 5. The cost of each of the areas 5 is, for example, a sum total of the required time for each segment in the area 5. In the area search processing, in a case in which there are a plurality of the traveling areas before the carrier 6 arrives at the target point 9, determined is the traveling area in which a total value of the required time of the areas 5 included in the traveling area is decreased or the smallest.

In the area search processing, the traveling area may be determined based on another piece of the basic information other than the required time, or the traveling area may be determined by combining elements of the basic information. For example, in the area search processing, the cost of the controlled area 5 may be increased in a case in which the number of the carriers in the area is equal to or larger than a predetermined number. In this case, an estimated conversion value of the required time corresponding to the number of the carriers in the area is added as the cost of the controlled area 5.

In the area search processing, the traveling route is determined based on the determined traveling area. For example, in the area search processing, the segments 3 and 4 in each of the areas 5 included in the determined traveling area are selected so that the subject carrier 6 reaches the target point 9 from the present point, and a route along the selected segments 3 and 4 is determined to be the traveling route. In the area search processing, a method for determining the traveling route based on the traveling area may be the same as a method of the segment search processing (described later).

In the segment search processing, determined is the traveling route including the segments 3 and 4 through which the subject carrier 6 passes before arriving at the target point 9 based on the basic information obtained by each of the area controllers 11. In the segment search processing, the traveling route including the segments 3 and 4 through which the carrier 6 passes before arriving at the target point 9 is determined so that a total value of costs of the segments 3 and 4 of the traveling route is decreased or minimized. For example, in the segment search processing, the segments 3 and 4 through which the carrier 6 can pass before arriving at the target point 9 are extracted, and a candidate route that can connect the present point of the carrier 6 to the target point 9 is derived. The total value is then calculated by totaling the costs of the segments included in the candidate route, and the candidate route the total value of which is decreased or the smallest is set as the traveling route.

The cost of each of the segments is calculated based on the basic information. The cost of each of the segments is, for example, calculated based on the required time of the segment. In the segment search processing, in a case in which there are a plurality of the traveling routes for the carrier 6 to arrive at the target point 9, determined is the traveling route in which the total value of the required time of the segments 3 and 4 included in the traveling route is the smallest.

In the segment search processing, the traveling route may be determined based on another piece of the basic information other than the required time, or the traveling area may be determined by combining elements of the basic information. For example, in the segment search processing, the cost of the segment is increased in a case in which the required time is equal to or longer than a predetermined time. For example, the cost of the segment is increased in a case in which a passing speed is equal to or lower than a predetermined speed. Furthermore, the cost of the segment is increased in a case in which the number of the carriers in the segment is equal to or larger than a predetermined number. Additionally, the cost of the segment is increased in a case in which a divided value is smaller than a predetermined value. In these cases, an estimated conversion value of the required time corresponding to the required time, the passing speed, the number of the carriers in the segment, and the divided value is added as the cost of the controlled area 5. The segment search processing may be performed after determining the traveling area in the area search processing, or may be performed for the entire rail 2 when the area search processing is not performed.

Figure 5:
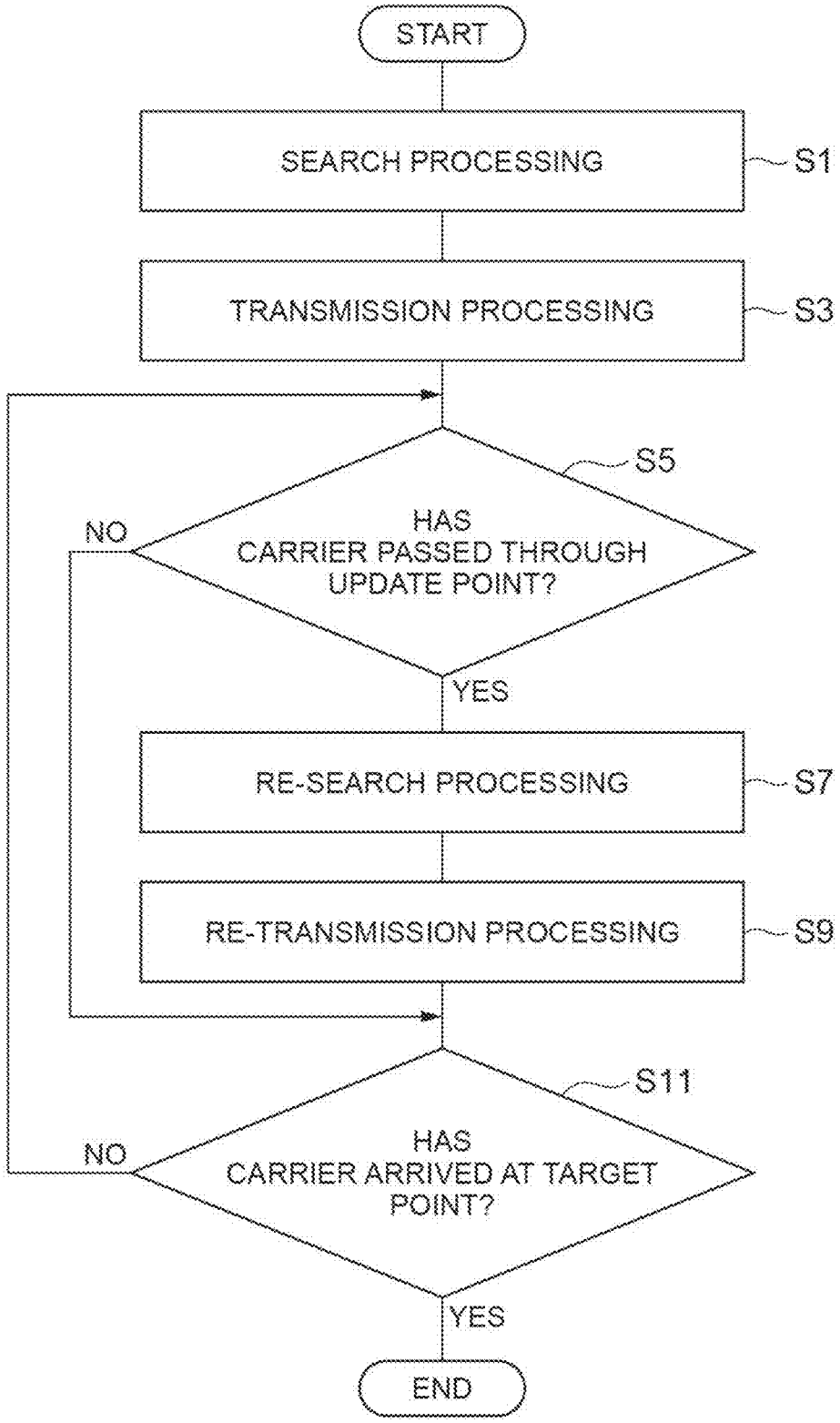
FIG. 5 is a flowchart illustrating processing performed by the conveyance system in FIG. 1.

Next, the following describes an example of processing performed by the conveyance system 1. Pieces of processing of a flowchart illustrated in FIG. 5 are, for example, performed in a case in which the area controller 11 receives, from the host controller 19, a request to convey the article 26 to the target point 9.

The route search unit 12 of the area controller 11 searches for the traveling route satisfying the request from the host controller 19 as the search processing (S1) for the subject carrier 6. The route search unit 12 searches for the traveling route of the subject carrier 6 based on the state report received from the subject carrier 6, the basic information received from the host controller 19, and the layout data as data related to the layout of the rail 2. The route search unit 12 performs, for example, the area search processing, and performs the segment search processing thereafter.

Subsequently, the area controller 11 creates the conveyance command including the traveling command to cause the subject carrier 6 to travel along the searched traveling route. The communication unit 13 of the area controller 11 then transmits the conveyance command to the subject carrier 6 as the transmission processing (S3). The subject carrier 6 that has received the conveyance command starts to travel along the traveling route included in the conveyance command.

Subsequently, the area controller 11 determines whether the subject carrier 6 has passed through the update point 7 as passage determination processing (S5). In a case in which the communication unit 13 receives the state report indicating that the subject carrier 6 has passed through the update point 7 from the carrier 6, the area controller 11 determines that the carrier 6 has passed through the update point 7 (YES at S5), and advances the process to the next re-search processing (S7). In a case in which the communication unit 13 does not receive the state report indicating that the subject carrier 6 has passed through the update point 7 from the carrier 6, it is determined that the carrier 6 has not passed through the update point 7 (NO at S5), and advances the process to arrival determination processing (S11) (described later).

The route re-search unit 14 of the area controller 11 performs the re-search processing (S7). The route re-search unit 14 causes the route search unit 12 to perform the search processing (S1) again as the re-search processing (S7). The area controller 11 creates the conveyance command including the traveling command to cause the subject carrier 6 to travel along the re-searched traveling route. The communication unit 13 of the area controller 11 then transmits the conveyance command to the subject carrier 6 as retransmission processing (S9). The subject carrier 6 that has received the conveyance command starts to travel along the traveling route included in the conveyance command. The subject carrier 6 that has received the updated conveyance command stops traveling along the traveling route included in the existing conveyance command, and travels along the traveling route included in the updated conveyance command.

The communication unit 13 of the area controller 11 determines whether the subject carrier 6 has arrived at the target point 9 as the arrival determination processing (S11). If it is determined that the subject carrier 6 has arrived at the target point 9 (YES at S11) based on the layout data and the state report of the present point received from the subject carrier 6, the communication unit 13 ends conveyance of the subject carrier 6. If it is determined that the subject carrier 6 has not arrived at the target point 9 (NO at S11) based on the layout data and the state report of the present point received from the subject carrier 6, the communication unit 13 repeats the passage determination processing (S5) and the pieces of processing subsequent thereto.

As described above, in the conveyance system 1, the traveling route is re-searched for when the carrier 6 passes through the update point 7, so that it is possible to re-search for and update the traveling route at an appropriate timing determined in advance by determining the update point 7 at an appropriate position, for example. Due to this, for example, it is possible to prevent the timing of re-search from becoming too late or prevent re-searching from being infrequent, and the required time to the target point for the carrier 6 can be appropriately reduced. In other words, the traveling route of the carrier can be updated at an appropriate timing, and conveyance efficiency can be improved.

The controller 10 performs the search processing (S1), the transmission processing (S3), the re-search processing (S7), and the retransmission processing (S9). Due to this, the controller 10 can search and re-search for the traveling route of the carrier 6, and can control traveling of the carrier.

The update point 7 is a point at a boundary between the areas 5 adjacent to each other. In this case, the traveling route of the carrier 6 can be updated to be an appropriate route at a timing when the carrier 6 passes through the update point 7 provided at the boundary between the areas 5.

The area controllers 11 are provided for the respective areas 5, and each of the area controllers 11 controls the carrier 6 in each of the areas 5. In this case, the traveling route of the carrier 6 can be updated to be an appropriate route at a timing when the carrier 6 passes through the update point 7 provided at the boundary between the areas 5 in which each of the area controllers 11 controls the carrier 6. The traveling route of the carrier 6 in the area 5 can be re-searched for and updated by one of the area controllers 11 assigned to one of the areas 5, so that a calculation load for one area controller 11 can be reduced. Furthermore, the host controller 19 does not necessarily control all of the carriers 6 on the rail 2, so that the calculation load of the host controller 19 can be reduced.

The power supply 15 may be provided for each of the areas 5. Due to this, the traveling route of the carrier 6 can be updated to be an appropriate route at a timing when the carrier 6 passes through the update point 7 provided at the boundary between the areas 5 in which each of the power supplies 15 supplies power. For example, even in a case in which a certain defect is caused in a power supply situation in certain one of the areas 5, power supply situations of the other areas 5 are not affected, so that each of the carriers 6 can travel in the other areas 5 while avoiding the certain area 5 to arrive at the target point 9.

The route search unit 12 and the route re-search unit 14 perform the area search processing. In this case, in search of the traveling route, the traveling route can be determined so that the cost to reach the target point 9 of the carrier 6 is reduced (for example, the required time is shortened) based on the areas 5 through which the carrier 6 passes before arriving at the target point 9. Additionally, a detailed route is not necessarily calculated by the segment search processing and the like for the areas 5 other than the traveling area through which the carrier 6 can pass. Thus, the conveyance system 1 can reduce the calculation load related to determination of the traveling route.

In the area search processing, in a case in which a predetermined number or more of the carriers 6 are present in the area 5, the cost of this area 5 is increased. In this case, the traveling route can be determined to avoid the area 5 in which the predetermined number or more of the carriers 6 are present.

The route search unit 12 and the route re-search unit 14 perform the segment search processing. In this case, in search of the traveling route, it is possible to determine the traveling route including the segments 3 and 4 through which the carrier 6 passes before arriving at the target point 9 so that the cost to reach the target point 9 of the carrier 6 is reduced (for example, the required time is shortened).

In a case in which the time required for the carrier 6 to pass through the segment 3 (segment 4) (required time) is equal to or longer than the predetermined time, the cost of the segment 3 (segment 4) is increased. In this case, the traveling route can be determined to avoid the segment in which the time required for the carrier 6 to pass through the segment 3 (segment 4) is equal to or longer than the predetermined time.

In a case in which the speed (passing speed) of the carrier 6 at the time of passing through the segment 3 (segment 4) is equal to or lower than the predetermined speed, the cost of the segment 3 (segment 4) is increased. In this case, the traveling route can be determined to avoid the segment in which the speed of the carrier at the time of passing through the segment is equal to or lower than the predetermined speed.

In a case corresponding to a case in which the predetermined number or more of the carriers 6 are present in the segment 3 (segment 4), the cost of the segment 3 (segment 4) is increased. In this case, the traveling route can be determined to avoid the segment in which the predetermined number or more of the carriers are present.

In a case in which a value (divided value) obtained by dividing the length of the segment 3 (segment 4) by the number of the carriers present in the segment 3 (segment 4) is smaller than the predetermined value, the cost of the segment 3 (segment 4) is increased. In this case, the traveling route can be determined to avoid the segment in which the value obtained by dividing the length of the segment 3 (segment 4) by the number of the carriers present in the segment 3 (segment 4) is smaller than the predetermined value. In the conveyance system 1 described above, the costs of the routes as candidates for the traveling route are compared with each other, and the route having the smallest value is selected as the traveling route. Thus, even in a case in which the cost is increased, the traveling route including the segment the cost of which is increased may be selected in some cases.

Example embodiments of the present invention have been described above. However, the present invention is not limited to the example embodiments described above, and can be variously modified without departing from the gist of the present invention. For example, the method of the area search processing and the method of the segment search processing are not particularly limited, and various known methods can be used.

In the example embodiments described above, a portion of or all of the processing performed by each of the area controllers 11 may be performed by each of the carriers 6, the host controller 19, another controller, and any one of them. For example, the host controller 19 may perform the search processing (S1), the transmission processing (S3), the re-search processing (S7), and the retransmission processing (S9) in all or part of the areas 5. For example, each of the carriers 6 may communicate with the host controller 19, and perform the search processing (S1), the transmission processing (S3), the re-search processing (S7), and the retransmission processing (S9).

In the example embodiments described above, the update point 7 is not necessarily provided at the boundary between the areas 5. For example, the update point 7 may be provided at the merging point or the diverging point, or may be provided on the segments 3 and 4 that are not present at the boundary between the areas 5. In the segment 4 connecting the certain subject area 5 and the area 5 adjacent to the subject area 5, the update point 7 may be provided in the subject area 5 on a near side (upstream side) with respect to the boundary between the areas 5. In the segment 4 connecting the certain subject area 5 and the area 5 adjacent to the subject area 5, the update point 7 may be provided in the adjacent area 5 on a far side (downstream side) with respect to the boundary between the areas 5. A point mark such as a barcode may be attached to the update point 7.

In the example embodiments described above, the area controller 11 is not necessarily provided for each of the areas 5. For example, the area controller 11 may control the carriers 6 in a plurality of the areas 5. The power supply 15 is not necessarily provided for each of the areas 5. For example, the power supply 15 may supply power to a plurality of the areas 5.

In the example embodiments described above, re-search of the traveling route may be permitted and stopped in response to an input operation by the user input via an operation unit, for example. In this case, for example, the user can selectively switch between a mode of performing re-search of the traveling route and a mode of not performing re-search of the traveling route as needed.

It is discovered and confirmed that, in a case of re-searching for the traveling route, if a temporal interval between previous search and current search is short, a change between a previous traveling route and a current traveling may be small in some cases. Thus, in the example embodiments described above, for example, in a case in which the number of the segments or a distance between the starting point 8 or the update point 7 through which the subject carrier 6 has passed and the target point 9 is equal to or smaller than a predetermined value, re-search of the traveling route may be stopped. In the example embodiments described above, for example, in a case in which a predetermined time has not elapsed from the time when the first search processing (S1) is performed or the time when the latest re-search processing (S7) is performed, re-search of the traveling route may be stopped. Due to this, a calculation load related to re-search can be reduced.

It is discovered and confirmed that, as the carrier 6 is closer to the starting point 8, an elapsed time from the time when an initial traveling route is searched for is shorter, so that a change in the situation of the rail 2 (congestion situation and the like) is small, and a change between the initial traveling route and the re-searched traveling route is small in some cases.

Thus, in the example embodiments described above, for example, in a case in which the carrier 6 is close to the starting point 8, the route re-search unit 14 may reduce a frequency of re-searching for the traveling route to be lower than a predetermined frequency. In the example embodiments described above, as a distance between a position at which the carrier 6 is traveling and the starting point 8 is increased, the route re-search unit 14 may increase the frequency of re-searching for the traveling route. In the example embodiments described above, for example, in a case in which the carrier 6 is traveling at a position within a predetermined distance from the starting point 8, the route re-search unit 14 may stop re-search of the traveling route. In the example embodiments described above, in a case in which the carrier 6 is traveling at a position distant from the starting point 8 by a predetermined distance or more, the route re-search unit 14 may start re-search of the traveling route. Due to this, a frequency of calculating the traveling route by the area controller 11 can be lowered, and the calculation load can be reduced.

It is also discovered and confirmed that, as the carrier 6 is closer to the target point 9, the number of candidates for other traveling routes is reduced, the traveling routes with which the required time is shortened as compared with the traveling route on which the carrier 6 has already traveled, so that a change between the traveling route on which the carrier 6 has already traveled and the re-searched traveling route may also be small in some cases. Thus, in the example embodiments described above, for example, in a case in which the carrier 6 is close to the target point 9, the route re-search unit 14 may reduce the frequency of re-searching for the traveling route to be lower than the predetermined frequency. In the example embodiments described above, as a distance between the position at which the carrier 6 is traveling and the target point 9 is reduced, the route re-search unit 14 may reduce the frequency of re-searching for the traveling route. In the example embodiments described above, for example, in a case in which the carrier 6 is traveling at a position within the predetermined distance from the target point 9, the route re-search unit 14 may stop re-search of the traveling route. In the example embodiments described above, in a case in which the carrier 6 is traveling at a position distant from the target point 9 by the predetermined distance or more, the route re-search unit 14 may perform re-search of the traveling route at the predetermined frequency. Due to this, the frequency of calculating the traveling route by the area controller 11 can be lowered, and the calculation load can be reduced.

In the example embodiments described above, an automated guided vehicle of an overhead traveling type is used as the carrier 6, but the carrier 6 is not particularly limited. The carrier 6 may be a shuttle of an overhead traveling type. The carrier 6 may be an automated guided carrier of a rail type that can travel along a rail on a floor. The carrier 6 may be an automated guided vehicle of a magnetic induction type that can travel along a route configured by magnetic tape and the like. The carrier 6 may be an automated guided carrier of a laser-guided type that can travel along a determined route by being guided by laser light.

An amount of cost is appropriately determined, the amount of cost being increased in accordance with an increase in the number of the carriers in each of the areas 5, an increase in the required time in each of the segments 3 (segments 4), an increase in the number of the carriers, a decrease in the passing speed, or a decrease in the divided value. In other words, weights may be assigned to respective items including the number of the carriers, the required time, the passing speed, and the divided value, and an amount of cost to be increased may be optionally determined.

In the example embodiments described above, one or a plurality of other controllers may be provided to relay between the area controller 11 and the carrier 6. A material and a shape of each configuration of the example embodiments described above are not limited, and various materials and shapes can be applied thereto. In the rail 2, settings of the segments 3 and 4, and the areas 5 are not limited to those in the example embodiments described above. For example, the rail 2 does not necessarily include one of the segment 3 extending in a linear shape and the segment 4 extending in a curved shape.

Figure 6:
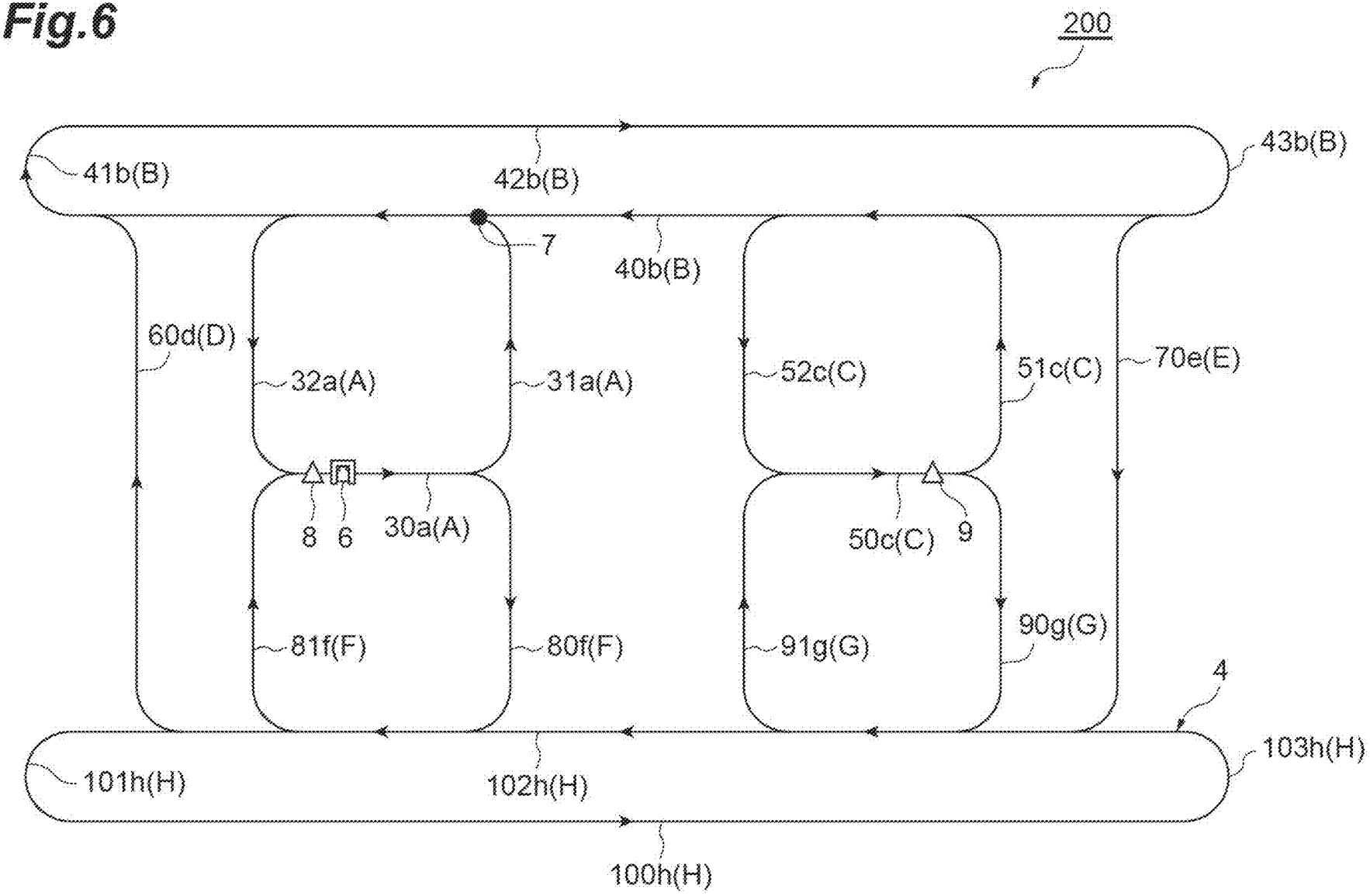
FIG. 6 is a schematic configuration diagram of the conveyance system for explaining an example of processing performed by the conveyance system in FIG. 1.
Figure 7:
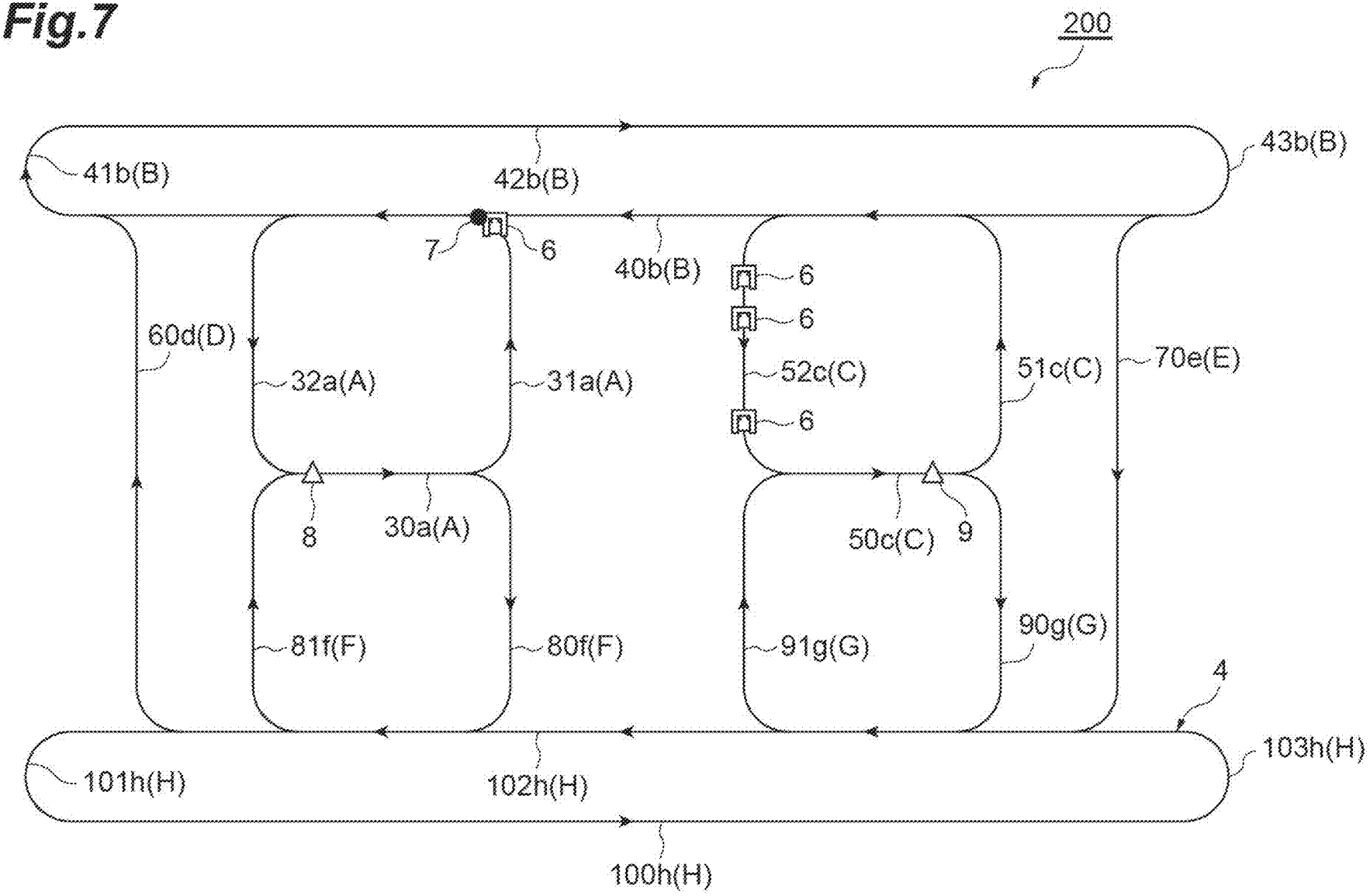
FIG. 7 is a schematic configuration diagram of the conveyance system for explaining an example of processing performed by the conveyance system in FIG. 1.
Figure 8:
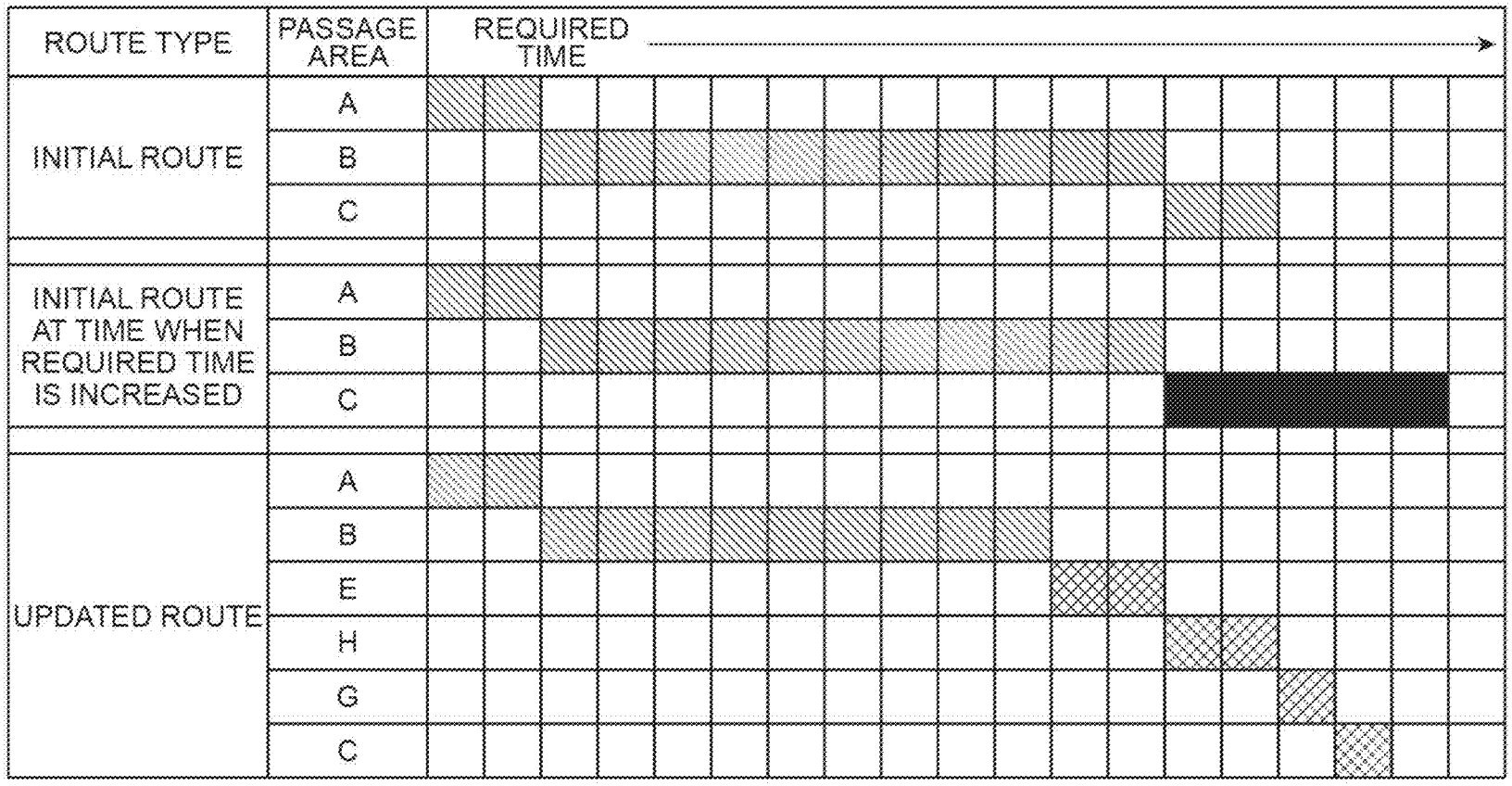
FIG. 8 is a graph illustrating an example of a result of the processing performed by the conveyance system in FIG. 1.

The following describes working effects of the conveyance system 1 using examples in FIG. 6, FIG. 7, and FIG. 8. In FIG. 6, the controller 10 and the power supply 15 are not illustrated, and the rail 2 is illustrated in a simplified form. In the example illustrated in FIG. 6, the rail 2 extends through a plurality of areas A to H. The area A includes segments 30*a*, 31*a*, and 32*a*, the area B includes segments 40*b*, 41*b*, 42*b*, and 43*b*, the area C includes segments 50*c*, 51*c*, and 52*c*, the area D includes a segment 60*d*, the area E includes a segment 70*e*, the area F includes segments 80*f* and 81*f*, the area G includes segments 90*g* and 91*g*, and the area H includes segments 100*h*, 101*h*, 102*h*, and 103*h*.

Herein, the following describes an example of causing the carrier 6 to travel from the starting point 8 provided in the segment 30*a* to the target point 9 provided in the segment 50*c*. In the example illustrated in FIG. 6, first, when the carrier 6 is positioned at the starting point 8, the search processing as the area search processing is performed, and an initial route is determined to be the traveling route. The initial route is, for example, a route based on the traveling area passing through the area A, the area B, and the area C in this order. The conveyance command including the traveling command to cause the carrier 6 to travel along the initial route is assigned to the carrier 6, and the carrier 6 starts to travel along the initial route.

As illustrated in FIG. 7, when the carrier 6 passes through the segment 31*a* and the update point 7 (boundary between the area A and the area B), the predetermined number or more of the carriers 6 are present in the segment 52*c* of the area C, that is, congestion is caused due to local concentration in the segment 52*c* of the area C. In this case, the required time for passing through the area C becomes long, so that the cost of the area C is increased. If the initial route is kept as the traveling route, there is the possibility that the required time to the target point 9 is increased.

From this viewpoint, in the conveyance system 1, the re-search processing is performed when the carrier 6 passes through the update point 7. Due to this, the traveling area avoiding the area C is determined, and an updated route is determined to be the traveling route based on the traveling area. The updated route is, for example, a route based on the traveling area passing through the area A, the area B, the area E, the area H, the area G, and the area C in this order. The conveyance command including the traveling command to cause the carrier 6 to travel along the updated route is assigned to the carrier 6, and the carrier 6 travels toward the target point 9 along the updated route instead of the initial route.

The graph illustrated in FIG. 8 indicates the required time for each route. In the graph in the drawing, as filled-in squares of the required time for each route is longer in a right direction, it is indicated that the required time for the route is longer. As illustrated in FIG. 8, if the initially searched initial route is kept as the traveling route, in a case in which congestion is caused due to local concentration in the area C, the required time for passing through the area C is increased, and as a result, the required time to the target point 9 is increased. On the other hand, in the conveyance system 1, in a case in which congestion is caused due to local concentration in the area C, the required time to the target point 9 is prevented from being increased by updating the traveling route to the updated route. It can be confirmed that the required time for the carrier 6 to the target point 9 can be appropriately reduced, and conveyance efficiency can be improved.

In the example embodiments described above, exemplified is the traveling route of the traveling command included in the conveyance command, but the traveling route is not limited thereto. For example, the traveling route may be a traveling route of a traveling command included in a movement command to guide (move) the carrier 6 to a predetermined position, a traveling route of a circuit command to cause the carrier 6 to travel while going around the rail 2, or a traveling route of any other command.

While example embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A conveyance system comprising:

a plurality of carriers capable of traveling along a rail that extends through a plurality of areas; and a controller configured or programmed to control the carriers, the controller being provided for each of the plurality of areas, and each of the controllers being configured or programmed to control at least one of the plurality of carriers in each of the plurality of areas and cause the conveyance system to:

search for a traveling route allowing at least one of the plurality of carriers to travel along the rail to a target point to cause the at least one of the plurality of carriers to travel along the traveling route; and re-search for the traveling route in a case in which the at least one of the plurality of carriers passes through an update point set on the rail; wherein the update point is at a boundary between adjacent ones of the plurality of areas.

2. The conveyance system according to claim 1, wherein the controller is configured or programmed to perform:

search processing of searching for the traveling route;

transmission processing of transmitting, to the at least one of the plurality of carriers, a traveling command to cause the at least one of the plurality of carriers to travel along the searched traveling route in a case in which the search processing is performed; and re-search processing of performing the search processing again in a case in which the at least one of the plurality of carriers passes through the update point.

3. The conveyance system according to claim 1, further comprising:

a power supply located along the rail to supply power to the at least one of the plurality of carriers; wherein the power supply is provided for each of the plurality of areas.

4. The conveyance system according to claim 1, wherein a traveling area including the plurality of areas through which the at least one of the plurality of carriers passes before arriving at the target point is determined so that a total value of costs of the respective areas of the traveling area is decreased or minimized; and the traveling route is determined based on the determined traveling area.

5. The conveyance system according to claim 4, wherein, in a case in which a predetermined number or more of the plurality of carriers are present in the traveling area, the cost of the area is increased.

6. A conveyance system comprising:

a plurality of carriers capable of traveling along a rail that includes a plurality of segments; and a controller configured or programmed to control the carriers and cause the conveyance system to:

search for a traveling route allowing at least one of the plurality of carriers to travel along the rail to a target point to cause the at least one of the plurality of carriers to travel along the traveling route, wherein the traveling route including the plurality of segments through which the at least one of the plurality of carriers passes before arriving at the target point is determined so that a total value of costs of the respective segments of the traveling route is decreased or minimized; and re-search for the traveling route in a case in which the at least one of the plurality of carriers passes through an update point set on the rail.

7. The conveyance system according to claim 6, wherein, in a case in which a time required for the at least one of the plurality of carriers to pass through the respective segment is equal to or longer than a predetermined time, the cost of the respective segment is increased.

8. The conveyance system according to claim 6, wherein, in a case in which a speed of the at least one of the plurality of carriers at the time of passing through the respective segment is equal to or lower than a predetermined speed, the cost of the respective segment is increased.

9. The conveyance system according to claim 6, wherein, in a case in which a predetermined number or more of the plurality of carriers are present in the respective segment, the cost of the respective segment is increased.

10. The conveyance system according to claim 6, wherein, in a case in which a value obtained by dividing a length of the respective segment by a number of the plurality of carriers present in the respective segment is smaller than a predetermined value, the cost of the segment is increased.

11. The conveyance system according to claim 1, wherein re-search of the traveling route is permitted and stopped in response to an input operation by a user.

12. A conveyance system comprising:

a plurality of carriers capable of traveling along a rail that extends through a plurality of areas;

a power supply located along the rail to supply power to the at least one of the plurality of carriers; and a controller configured or programmed to control the carriers and cause the conveyance system to:

search for a traveling route allowing at least one of the plurality of carriers to travel along the rail to a target point to cause the at least one of the plurality of carriers to travel along the traveling route; and re-search for the traveling route in a case in which the at least one of the plurality of carriers passes through an update point set on the rail; wherein the update point is at a boundary between adjacent ones of the plurality of areas; and the power supply is provided for each of the plurality of areas.

13. The conveyance system according to claim 12, wherein the controller is configured or programmed to perform:

search processing of searching for the traveling route;

transmission processing of transmitting, to the at least one of the plurality of carriers, a traveling command to cause the at least one of the plurality of carriers to travel along the searched traveling route in a case in which the search processing is performed; and re-search processing of performing the search processing again in a case in which the at least one of the plurality of carriers passes through the update point.

* * * * *